United States Patent [19]

Vela

[11] 3,938,720

[45] Feb. 17, 1976

[54] WALLET WITH CARRYING HARNESS

[76] Inventor: La Verne M. Vela, 675 Pearson, Ferndale, Mich. 48220

[22] Filed: Dec. 10, 1970

[21] Appl. No.: 96,849

[52] U.S. Cl. ..... 224/5 R; 224/26 R
[51] Int. Cl.[2] ..... A45C 1/00
[58] Field of Search ..... 224/5 R, 5 L, 5 K, 5 N, 224/5 M, 5 Y, 26 R, 26 F, 2 B, 26.2, 26.3

[56] References Cited

UNITED STATES PATENTS

| | | | |
|---|---|---|---|
| 1,287,875 | 12/1918 | Careless | 224/26 F |
| 1,493,594 | 5/1924 | Binns | 224/26 C |
| 2,819,830 | 1/1958 | Murray | 224/2 B |
| 3,322,311 | 5/1967 | Homer | 224/5 R |

*Primary Examiner*—Robert J. Spar
*Assistant Examiner*—Jerold M. Forsberg
*Attorney, Agent, or Firm*—A. F. Baillio

[57] ABSTRACT

A wallet for wear beneath the clothing of a person which includes a longer elastic band of a length to snugly fit around the waist of the wearer, a shorter elastic band of a length to fit snugly around the upper thigh of the wearer and a flat pocket-like body so attached at one end to one band and at the other end to the other band and of such length that when the wearer stands it is tightened in both directions and thus held flatly against the body of the wearer.

1 Claim, 3 Drawing Figures

INVENTOR.
LAVERNE M. VELA
BY

WALLET WITH CARRYING HARNESS

BACKGROUND OF INVENTION

This invention relates to wallets for carrying money, papers and other valuables on the person of the type which are attached to the person under clothing so as to safeguard the valuables and free the hands of the person. The devices shown in the Kepley U.S. Pat. No. 297,268, dated Apr. 22, 1884, and Careless U.S. Pat. No. 1,287,875, dated Dec. 17, 1918, are thought to be typical of the prior art known to the applicant.

SUMMARY OF THE INVENTION

The object of the invention is to provide a wallet of the character referred to which will remain concealed from sight under a minimum of clothing with a minimum of bulge to reveal its presence but will not restrict movement of the wearer but accommodate itself to his or her movements and be comfortable.

This objective is attained by providing a flat receptacle to be worn under the outer clothing between the waist and the upper thigh and held tensioned and snugly against the body by elastic bands which fit snugly around the waist and the upper thigh.

For a better understanding of the nature of the invention and a disclosure of the preferred embodiment thereof, reference is made to the accompanying drawing and the following description.

DESCRIPTION OF PREFERRED EMBODIMENT

Figure 1:
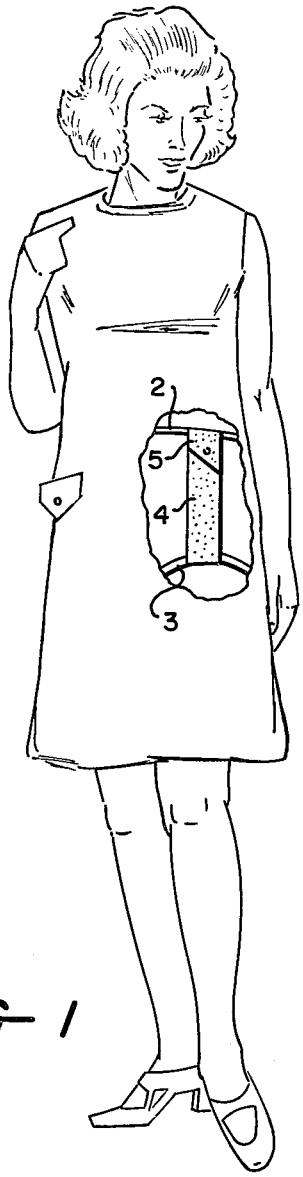
FIG. 1 is a view of a person wearing a wallet in accordance with my invention with a portion of the outer clothing broken away to show the wallet.
Figure 2:
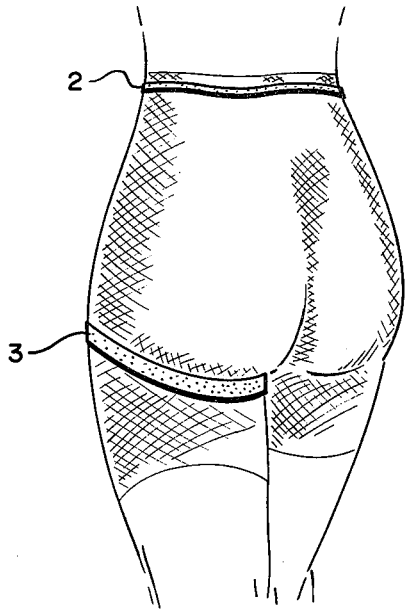
FIG. 2 is a rear view of the midsection of a person wearing the wallet.
Figure 3:
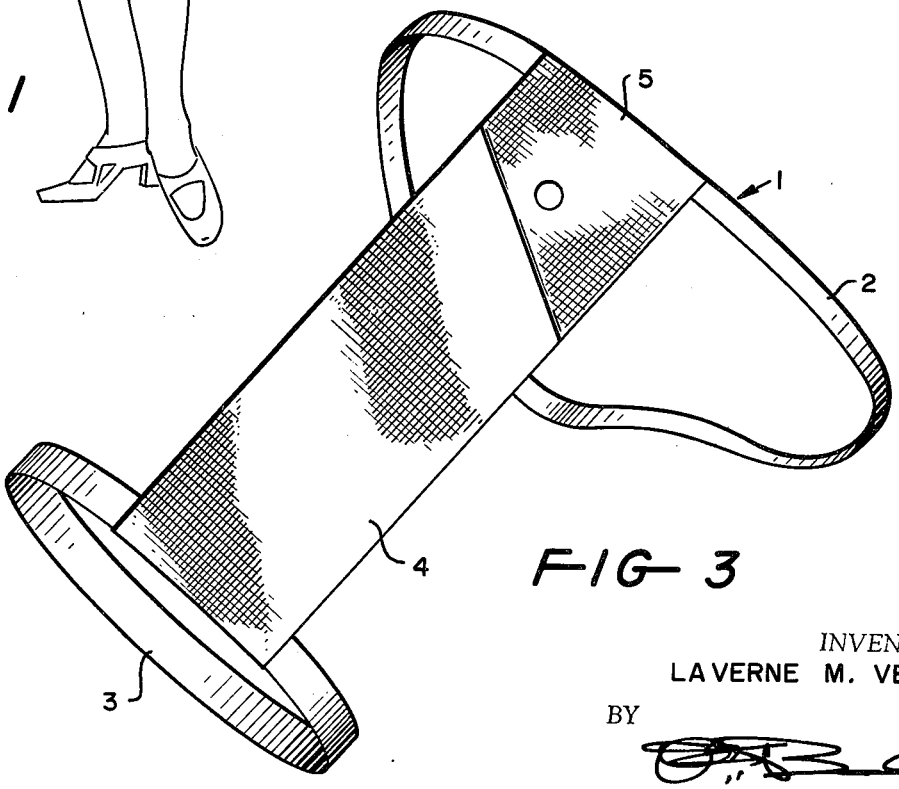
FIG. 3 is a perspective view of the wallet.

The wallet 1 shown in the drawing includes a longer upper elastic band 2 of a length to fit snugly around the waist of the wearer and a shorter lower elastic band 3 of a length to fit snugly around the upper thigh of the wearer. Between the two bands extends a pocket-like member 4 with an access opening at its upper end which may be closed by a flap 5 by a button or a snap or by a zipper or otherwise. The ends of the pocket-like member are attached to the ends of the bands 2 and 3 and the pocket-like member is of such length that when the wearer stands the pocket-like member is tightened in both directions and thus held flatly against the body of the wearer. Besides its function of cooperating with the band 2 to hold the pocket-like member flatly against the body, the band 3 also serves to prevent loss of the wallet in the event the band 2 breaks.

The wallet 1 is intended as shown in FIG. 1 to be worn beneath the outer clothing and will, therefore, not only be invisible under ordinary circumstances, but also because it is held flatly against the wearer's body will not reveal its presence by creating a noticeable bulge when snugly fitting clothing is worn. Because of the yieldability of the bands 2 and 3, the wallet will not restrict movement of the wearer but will accommodate itself to his or her movements and be comfortable but still remain in place despite the most violent movements.

1. The method of concealing a pocket-like member on the person which resides in suspending beneath the person's clothing under tension lengthwise and sidewise between an elastic band which fits snugly around the waist and an elastic band which fits snugly around an upper thigh of the person so that the member is held snugly against the body between the waist and a thigh of the person.

* * * * *